US007384080B2

(12) United States Patent
Kachouh

(10) Patent No.: US 7,384,080 B2
(45) Date of Patent: Jun. 10, 2008

(54) MOTOR VEHICLE LOCK WITH ELECTRICAL OPENING DRIVE

(75) Inventor: Checrallah Kachouh, Dortmund (DE)

(73) Assignee: Brose Schliesssysteme GmbH & Co. KG, Wuppertal (DE)

( * ) Notice: Subject to any disclaimer, the term of this patent is extended or adjusted under 35 U.S.C. 154(b) by 22 days.

(21) Appl. No.: 10/793,682

(22) Filed: Mar. 5, 2004

(65) Prior Publication Data

US 2004/0232707 A1 Nov. 25, 2004

(30) Foreign Application Priority Data

Mar. 8, 2003 (DE) ..... 103 10 507
Apr. 30, 2003 (DE) ..... 103 19 743

(51) Int. Cl.
*E05C 3/06* (2006.01)

(52) U.S. Cl. ..... 292/201; 292/216

(58) Field of Classification Search ..... 292/201, 292/216; 70/278.1, 279.1
See application file for complete search history.

(56) References Cited

U.S. PATENT DOCUMENTS 4,536,021 A * 8/1985 Mochida ..... 292/201
5,574,315 A * 11/1996 Weber ..... 307/10.1
5,613,716 A * 3/1997 Cafferty ..... 292/216
5,802,894 A * 9/1998 Jahrsetz et al. ..... 70/264
6,010,165 A * 1/2000 Santarelli et al. ..... 292/216
6,102,454 A * 8/2000 Weyerstall ..... 292/201
6,386,599 B1 * 5/2002 Chevalier ..... 292/201
6,435,573 B1 * 8/2002 Szablewski ..... 292/201
6,557,387 B2 5/2003 Kachouh
6,648,379 B1 * 11/2003 Kordowski et al. ..... 292/201
6,719,333 B2 * 4/2004 Rice et al. ..... 292/216
6,883,839 B2 * 4/2005 Belmond et al. ..... 292/201
2001/0037666 A1 * 11/2001 Roos et al. ..... 70/264

FOREIGN PATENT DOCUMENTS

DE 198 19 603 A1 11/1999
EP 1 061 212 B1 12/2000
EP 1 113 133 A1 7/2001

* cited by examiner

*Primary Examiner*—Gary Estremsky
(74) *Attorney, Agent, or Firm*—David S. Safran

(57) ABSTRACT

A motor vehicle lock with a blocking element (2), with a electrical opening drive (3) for the blocking element (2), with control electronics (8) in the motor vehicle lock or separately from it in the motor vehicle, by which individual functions of the motor vehicle lock can be electrically triggered, and a lock mechanism by which individual functions can also be mechanically triggered. The opening drive (3) has a drive element (6) which can be driven in two opposing directions of motion, movement of the drive element in the first direction of motion releases or open the blocking element (2) and movement in the second direction of motion turns on (or off) the second function of the motor vehicle lock. The lock has an especially simple structure since turning off the second function takes place without moving the opening drive (3) in the second direction of motion exclusively by electrical control.

15 Claims, 7 Drawing Sheets

MOTOR VEHICLE LOCK WITH ELECTRICAL OPENING DRIVE

BACKGROUND OF THE INVENTION

1. Field of the Invention

The invention relates to a motor vehicle lock with an electrical opening drive.

2. Description of Related Art

First of all, in general, motor vehicle locks basically have a lock mechanism by which the motor vehicle lock is to be switched into various operating states, for example, into the operating states double lock (DL), child safety (CS), center lock (CL) and unlock (UL) In the operating state UL, the door can be opened by actuating the inside door handle and the outside door handle. In the operating state CL, it is not possible to open from the outside, but it can be opened from the inside. In the operating state CS, it is possible to open the door from the outside, but not from the inside. In the operating state DL, it is not possible to open the door from either the outside or from the inside, so that, even when the window is smashed, the motor vehicle door cannot be opened.

Motor vehicle locks of the type under consideration are often equipped with an electric opening drive. Use of such locks began for rear hatch locks and rear door locks, but such use has since been expanded to motor vehicle side door locks which have a so-called OBW (open by wire) drive (electric motorized opening aid). These motor vehicle locks are acquiring great importance especially in conjunction with a passive entry system.

Basically, work has been underway for a long time on motor vehicle locks which operate exclusively electrically, i.e., they no longer have a lock mechanism. In terms of the basic principle, these motor vehicle locks have been known since the 1970's. They have only latches and ratchets and the electric motorized opening drive is for the ratchet (rotary drive, linear drive, solenoid, etc). All operating states are implemented exclusively electronically by the control electronics which clears or blocks access to the electrical opening drive.

Safety engineering considerations, as before, result in the fact that motor vehicle locks with an electrical opening drive are not made as purely electrical locks, and at least for key functions, have a mechanical redundancy. Then, there is at least another lock mechanism by which individual functions can also be mechanically triggered in any case in an emergency.

On the one hand, it is desirable for the motor vehicle lock to have a structure which is as simple as possible; this would militate in favor of a pure electric lock. On the other hand, safety engineering requirements must be met; this requires a lock mechanism and furthermore, entails the necessity of also being able to trigger the various operating states mechanically and electromechanically.

In individual cases, to trigger all functions including the electrical opening drive, three electric motorized drives are necessary, specifically an electromechanical central locking drive (for UL and CL), an electromechanical double lock drive (for DL and CS), and the electrical opening drive. It can be imagined what costs such a motor vehicle lock would engender.

Therefore, efforts are being directed at making do with as small a number of electric drives as possible, in spite of performing all functions and in spite of implementing sufficient mechanical redundancy. In addition, there is the desire to have to use as few microswitches or proximity electronic switches as possible for controlling the electric drive motors. Accordingly, it is preferred to have the operating states achieved as much as possible by blocking operations. In a blocking operation, the drive element which is driven by the electric drive motor runs against a more or less stationary stop. By monitoring the torque, preferably by current monitoring of the electric drive motor and/or by a timing circuit, then the electric drive motor is turned off in a quite specific position. Generally, resetting of the electric drive motor into a neutral position will preferably take place. However, resetting need not be approached especially accurately, it can even be accomplished mechanically by spring force resetting. With control of the electric drive motor in a blocking operation, at the same, time temperature-induced fluctuations are avoided in the position of the drive element which result in inevitable overtravel of the electric drive motor after being turned off by means of a switch.

One interesting step in the above explained development trend has already been made (European Patent EP 1 113 133 B1). In the motor vehicle lock there, from which the invention proceeds, the second function of the electrical opening drive is a child safety function. However, there is the problem that the child safety function can only be turned on by moving the drive element in the second direction of motion because the first direction of motion is "reserved" for the opening drive function. This problem is solved in the above explained design of a motor vehicle lock by a type of "ballpoint pen mechanism" of the child safety actuation. The second function is turned off in the same direction with turning-on in turn against a resetting spring force. This design is imaginative, but requires complex additional mechanical engineering in the form of the ballpoint pen mechanism.

Another approach consists in working with a "floating" blocking stop (European Patent EP 1 061 212 B1). The floating blocking stop results in the desired stop for implementing block operation for turning off the electric drive in the intermediate position. In this way, the turn-off position can be defined at almost any location which can be established beforehand, without using a switch. Implementation of an additional floating blocking stop is, of course, complex in mechanical-construction terms.

Finally, U.S. Pat. No. 6,557,387 (commonly owned) describes an especially feasible electric motorized actuator for a motor vehicle lock and the contents of this patent are hereby incorporated by reference into this application. With this actuator not only can operating states CL and UL of a motor vehicle lock be implemented, but also the operating state DL in any case. For this, a certain feasible control crank which has a catch is implemented, the double lock lever being kept in the operating state CL by latching after mechanical-manual shifting from the operating state DL into the operating state CL.

SUMMARY OF THE INVENTION

A primary object of the present invention is to further simplify the known motor vehicle lock with an electrical opening drive with respect to the use of the opening drive and the control of the opening drive, while also obtaining the necessary functions of mechanical redundancy.

The underlying idea of the invention is to devise a motor vehicle lock in which mechanical redundancy is minimized. It is recognized that mechanical redundancy is not necessary from each operating state, but in part electronic triggering is sufficient. There is thus a redundancy which acquires all necessary functions, but is not always active.

The aforementioned object is achieved in a first embodiment having a movable latch, a blocking element for holding the latch in a locked position, a motorized opening drive for the blocking element, control electronics which are adapted to electrically trigger individual functions of the motor vehicle lock, and a lock mechanism by which the individual functions can also be mechanically triggered in case of an emergency, by the opening drive having a drive element which opens or releases the blocking element in one direction of motion—first function—and a second function of the motor vehicle lock can be turned on and off without influencing the lock mechanism and without moving the opening drive, exclusively by electrical-control engineering means, the second function being mechanically turned off when the opening drive opens or releases the blocking element. In accordance with the invention, it has been recognized that it is possible to dispense with attaining the operating state CL or UL as such from the operating state DL immediately by means of the lock mechanism. The electrical opening drive can therefore be used in a second function, for example, for turning on the DL function. Another version would be implementation of the electrical child safety and the use of the opening drive in the second function for turning on the child safety CS. This operating state can be exited into the nearest operating state CL or UL, first of all, only electronically by means of triggering by the control electronics. The opening drive need not be moved for this purpose. No additional switch is necessary since an additional operating point is not required.

Nevertheless, the operating state CL or UL is easily reached when it becomes necessary, specifically when the opening drive is triggered for purposes of opening the motor vehicle lock. A motor vehicle lock which reaches the open position by means of the opening drive is logically, with respect to operation of the lock mechanism, in the state in which the second function is turned off, whether the double lock function DL or the child safety function CS.

The basis of the teaching is thus the recognition which results from exact analysis of the operating processes that mechanical redundancy is not necessary for the return from DL to CL or UL so that, as such, the electronic triggering is sufficient here. This saves a switch with double use of the opening drive.

The above explained manner of operation is of interest for turning off any second function of a motor vehicle lock, therefore the functions double lock (DL), child safety (CS), center lock (CL), turning off this function corresponding to turning on another function of the motor vehicle lock, especially the unlock (UL) function.

Depending on the approach, turning off a certain function can always be understood as turning on another function, the terms turning-on and turning-off are therefore interchangeable, they need simply be used consistently throughout in order to avoid misunderstanding.

However, in particular, it is also possible for the mechanical implementation of turning off the second function not to take place by the opening drive itself, but by another motorized drive, for example, of the central locking drive. The prerequisite for this is that there is another drive and that turning off the second function is triggered by the opening drive. The mechanical execution of turning-off by the other drive is then triggered by the control electronics.

In another embodiment, the above explained object is achieved in a motor vehicle lock having a latch, a blocking element which keeps the latch in the locked position, a motorized opening drive for the blocking element, the opening drive having a drive element which can be driven in each of two opposing directions of motion, control electronics for electrically triggering individual functions of the motor vehicle lock, and a lock mechanism by which individual functions can also be mechanically triggered in any case in an emergency, by the drive element of the opening drive in the first direction of motion engaging the blocking element or another lever which is coupled to it and opens the blocking element and wherein the drive element in the second direction of motion, in any case when the blocking element is closed, is blocked by the blocking element or the other lever after a certain path, and thus, turns on the second function . This approach follows from the recognition that the blocking element itself, or another lever which is coupled to the blocking element, can itself form the blocking stop which causes the second function to be turned on in block operation.

Of particular interest is the possibility of using, for the opening drive and the blocking element or other lever, the construction of a central lock drive which can be operated in two directions of rotation, one direction of rotation being used for the second function, especially DL or CS. In particular, drives with a fork latch construction (German Patent DE 198 19 603 C2), with a crank guide (U.S. Pat. No. 6,557,387) or with a double crank guide (commonly owned, co-pending U.S. patent application Ser. No. 10/684,255) are possible. The disclosure contents of the aforementioned publications are hereby incorporated by reference into this patent application.

An independent and subordinate approach to the aforementioned object is also possible in a motor vehicle lock having a latch, a blocking element which keeps the latch in the locked position, a motorized opening drive for moving the blocking element, control electronics by which individual functions of the motor vehicle lock can be electrically triggered, and a lock mechanism by which individual functions can also be mechanically triggered in an emergency, wherein the opening drive has a drive element which engages the blocking element or another lever which is coupled to it and opens the blocking element in the first direction of motion, wherein a storage element which, with the blocking element opened, assumes a storage position in which it keeps the blocking element in the open position until another operating state of the motor vehicle lock is reached that is assigned to the blocking element or another lever which is coupled to it.

Otherwise particulars are explained in detail below in conjunction with an explanation of preferred embodiments and with reference to the accompanying drawings.

DETAILED DESCRIPTION OF THE INVENTION

Figure 1:
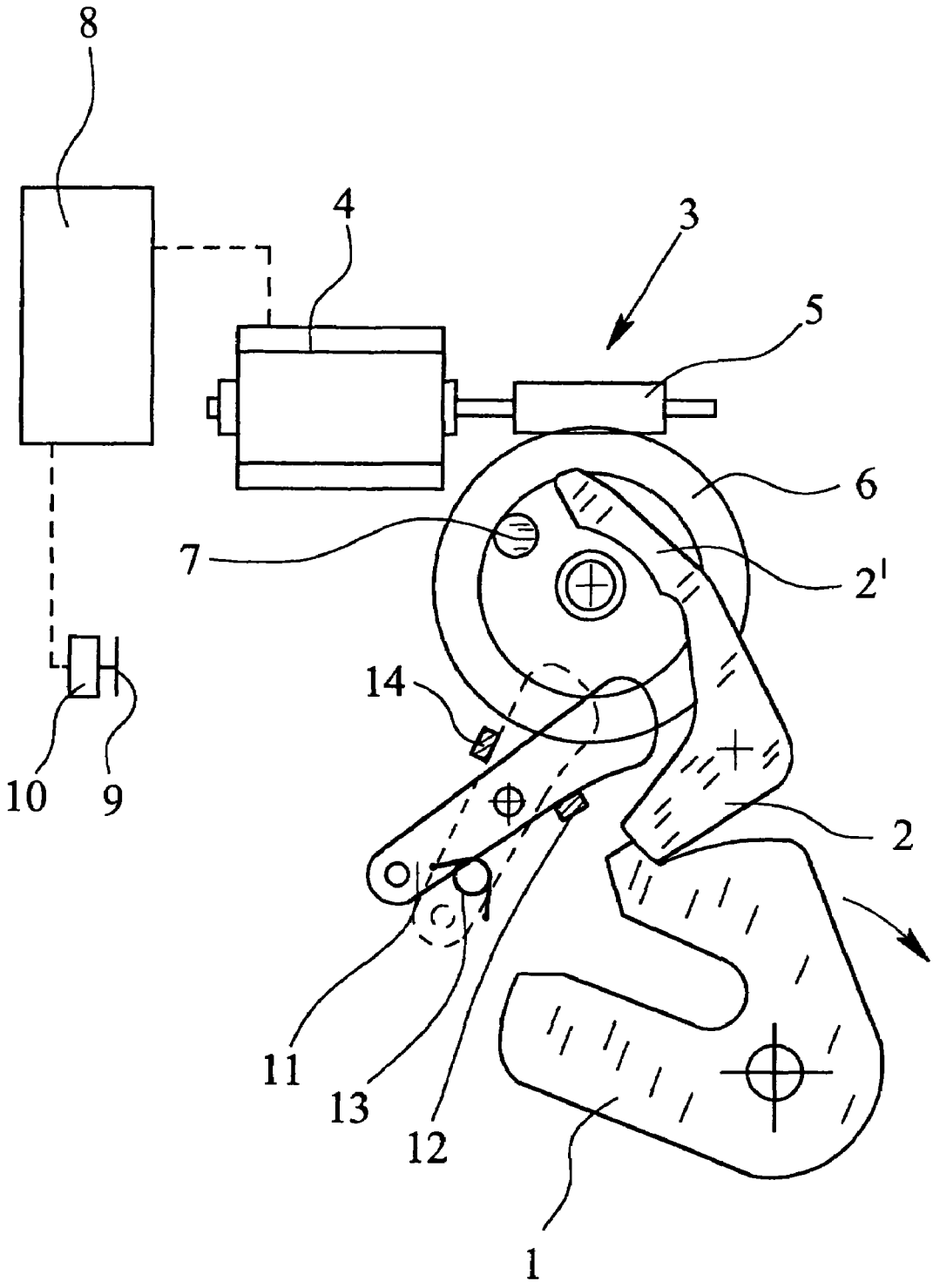
FIG. 1 is a schematic depiction of a first embodiment of a motor vehicle lock in accordance with the invention with an electrical opening drive.

FIG. 1 shows, first of all, the fundamental structure of a motor vehicle lock, not all parts of the motor vehicle lock being shown there. Only the parts of the motor vehicle lock which are important to an understanding of the teaching of the invention are shown. Otherwise reference should be made to the prior art named in the "Background" part of this application for structural embodiments of motor vehicle locks of the type under consideration, specifically motor vehicle locks with an opening drive.

The motor vehicle lock shown has a latch 1 which is held by a blocking element 2, here in the form of ratchet, in FIG. 1, in its main catch position. On the second fork leg of the latch 1, there is a preliminary catch against which the ratchet 2 can likewise fit. The opening direction of the latch 1 is toward the right in FIG. 1, and therefore yields clockwise rotation of the latch 1 in FIG. 1 as soon as the latch 1 has been released from the ratchet 2.

Instead of the rotary latch 1, any other latch such as, for example, a catch or safety bolt can be used. The invention is not limited to the latch I shown here in this respect.

Furthermore, an electrical opening drive 3 for the blocking element 2 is shown. The drive has an electric drive motor 4, step-down gearing 5 and a drive element 6 which is made here as a worm wheel. For the different drive techniques of these electric motorized drives for motor vehicle locks, reference should likewise be made to the initially explained prior art.

Instead of an electric motorized drive, it can also be another motorized drive, such as, for example, a hydraulic drive or a pneumatic drive.

In the illustrated embodiment, the drive element 6 is made as a worm wheel, as stated. On the worm wheel 6, there is a driver journal 7 which acts on the actuating arm 2' of the ratchet 2, which arm is formed as an integral part of the ratchet 2. However, basically, it is also possible to couple the blocking element 2, here therefore the ratchet, to another lever, often a drag lever, which makes it possible to allow the ratchet to freewheel in one direction.

Control electronics 8, which are shown only schematically in FIG. 1, are integrated into the motor vehicle lock or assigned to the motor vehicle lock; the opening drive 3 being triggered by the electronics at a given time. The control electronics 8 are triggered from different points. An inside door handle 9 is shown which influences the control electronics 8 by means of the switch 10 upon activation, such that the opening drive 3 is triggered if the inside door handle 9 is activated, therefore if the child safety CS or the double lock DL is not activated. For this typical control technology from the field of electric locks, reference should likewise be made to the prior art in this respect. The points noted relative to the inside door handle 9, of course, also apply to the outside door handle.

The drive element 6 of the opening drive 3 can be driven in two opposing directions of motion according to assumptions. In general it may move with a linearly operated drive element, but a rotary drive element 6 which is used more often is shown, as a worm wheel here. In the first direction of motion, clockwise in FIG. 1, the drive element 6, by means of the driver journal 7, opens the blocking element 2, releasing it from the rotary latch 1. In the second, opposite direction of motion the drive element 6 turns on the second function of the motor vehicle lock by means of the driver journal 7.

In this embodiment, in both directions of motion of the drive element 6, the opening drive 3 is turned off after a completed operation by block operation. The function of block operation has already been explained in the "Background" part of this specification. In any case, resetting of the opening drive 3, after turning-off in block operation, takes place in the illustrated embodiment into the neutral position of the driver journal 7 which is recognizable in FIG. 1. However, this position need not be maintained especially accurately, because it is relatively far away from the critical actuating positions.

There are also drive constructions for opening drives 3 which allow stopping of the opening drive 3 after turning-off in block operation. Reference also should be made to the initially explained prior art in this respect.

It is important to the motor vehicle lock shown that, in addition to the control electronics 8 by which the individual functions of the motor vehicle lock can be electrically triggered, there is still a lock mechanism by which, in any case, individual functions can also be mechanically triggered in an emergency. In this embodiment, a double lock lever 11 is shown which is present to move the motor vehicle lock with respect to the lock mechanism into the operating state double lock DL. The illustrated embodiment in FIG. 1 shows the "double-locked" operating position of the double lock lever 11. In the DL position, the double lock lever 11 is on the stop 12. It is reliably set there by the overcenter spring 13 which is shown here by way of example for the double lock lever 11.

FIG. 1 shows by a broken line the position of the double lock lever 11 which it assumes when the double lock DL is no longer turned on, therefore for the center lock CL position. There the double lock lever 11 is on the stop 14, in turn held there by the overcenter spring 13.

FIG. 1 makes it apparent that an important aspect of the invention lies in that the second function, therefore here the double lock DL function, as such is turned on solely electrically without movement of the opening drive 3 (out of the position shown in FIG. 1). In other words, the control electronics 8 can be triggered such that the operating state double lock DL is cancelled and the operating state center lock CL is turned on. This purely electrical change of the operating state, however, in the illustrated construction of the motor vehicle lock, has no effect on the double lock lever 11. This saves a switch or an additional state of the opening drive 3 and an additional drive for the double lock function.

This embodiment shows how the double lock lever 11 still reaches its position which corresponds to the center lock CL or the unlock UL state. If the opening drive 3 runs in the first direction of motion, and in doing so, opens the blocking element 2, the double lock lever 11 is shifted from the stop 12 to the stop 14 by the action of the blocking element 2 itself which then is turned clockwise. The function of opening the motor vehicle lock is thus converted mechanically into the function of turning off the double lock DL. This can also take place by direct actuation of the double lock lever 11 on the part of the driver journal 7 of the drive element 6, for example, when the double lock lever 11 in FIG. 1 is extended to the height of the actuating arm 2' of the ratchet 2.

A similar manner of operation as in the control of the double lock DL function can also be implemented, for example, in the control of the child safety CS function.

The above described version of the motor vehicle lock can generally be implemented for the second function so that the result is that the second function of the motor vehicle lock as such is turned off without influencing the lock mechanism and without moving the opening drive 3 exclusively by electrical-control engineering means and that the second function is mechanically turned off when the opening drive 3 opens or releases the blocking element 2.

In general, it applies that the second function is a double lock DL function, a child safety CS function or a center lock CL function and that turning off this function turns on another function, especially the unlock UL function.

Figure 1A:
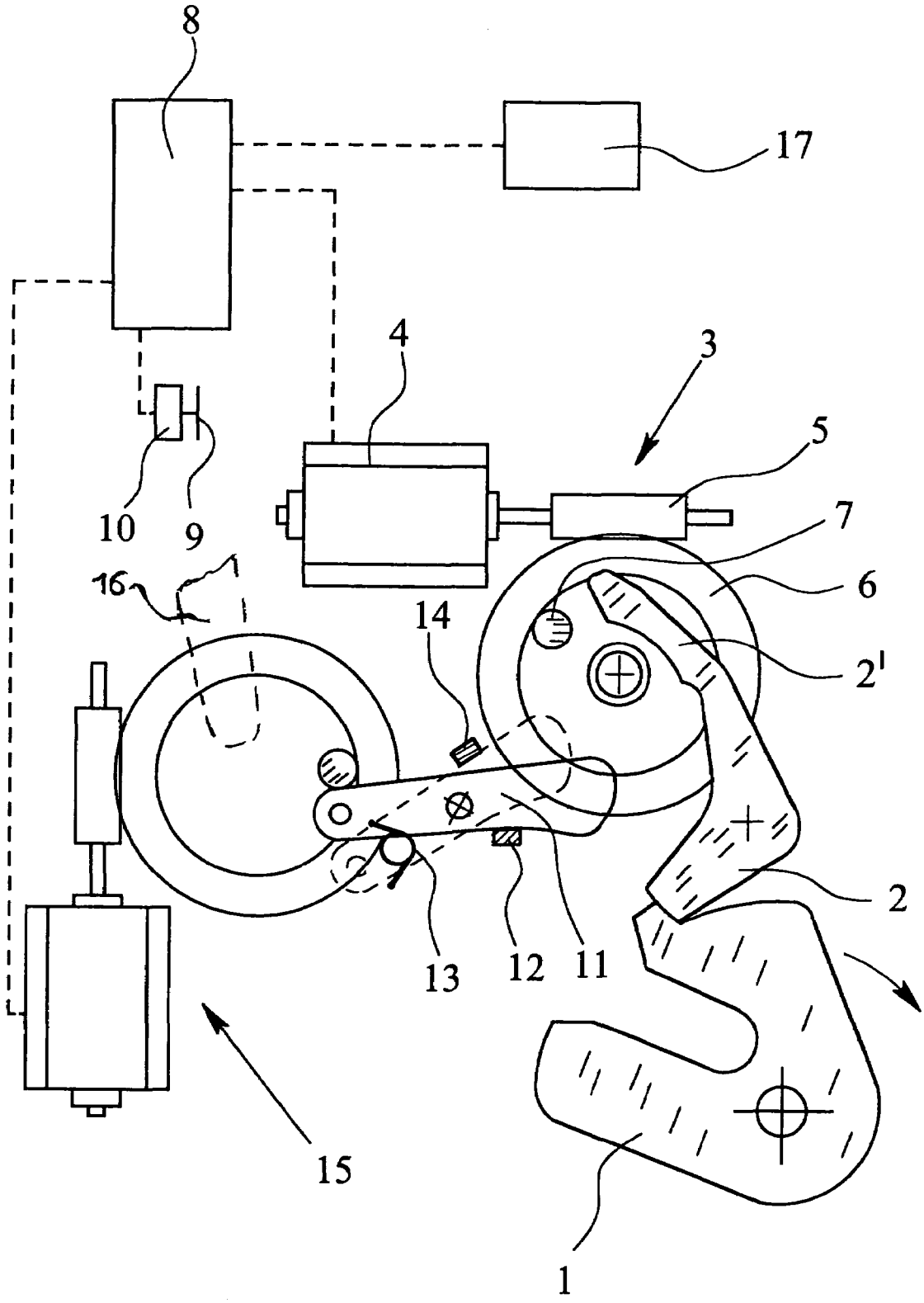
FIG. 1*a* is a schematic depiction of a second embodiment of a motor vehicle lock in accordance with the invention with an electrical opening drive.

The mechanical implementation of turning off the second function of the motor vehicle lock can take place by second motorized drive 15 of the lock mechanism instead of the opening drive 3. This second drive 15 can be, for example, a central locking drive. FIG. 1*a* shows a motor vehicle lock with a second drive 15 which is made here as an electric motorized drive and constitutes the central locking drive. Here, the central locking drive is, on the one hand, a drive for the double lock lever 11, and on the other hand, a drive for the child safety lever 16.

The second function is not turned off mechanically here by the opening drive 3 of the blocking element 2, but by the other drive 15 of the lock mechanism. The other drive 15 and the opening drive 3 are connected to one another by means of the control electronics 8 so that the other drive 15 then mechanically executes turning-off of the second function when the opening drive 3 opens or releases the blocking element 2.

In addition, FIG. 1*a* shows a crash sensor 17 which is connected to the control electronics 8. By means of the crash sensor 17 it is likewise possible to trigger mechanical execution of turning off the second function. This takes place when the crash sensor 17, as a result of an accident, delivers a corresponding signal to the control electronics 8. The latter then triggers mechanical execution of turning off the second function by the opening drive 3 or by the other drive 15. In this way, mechanical redundancy is also ensured for the case of a crash.

Figure 2:
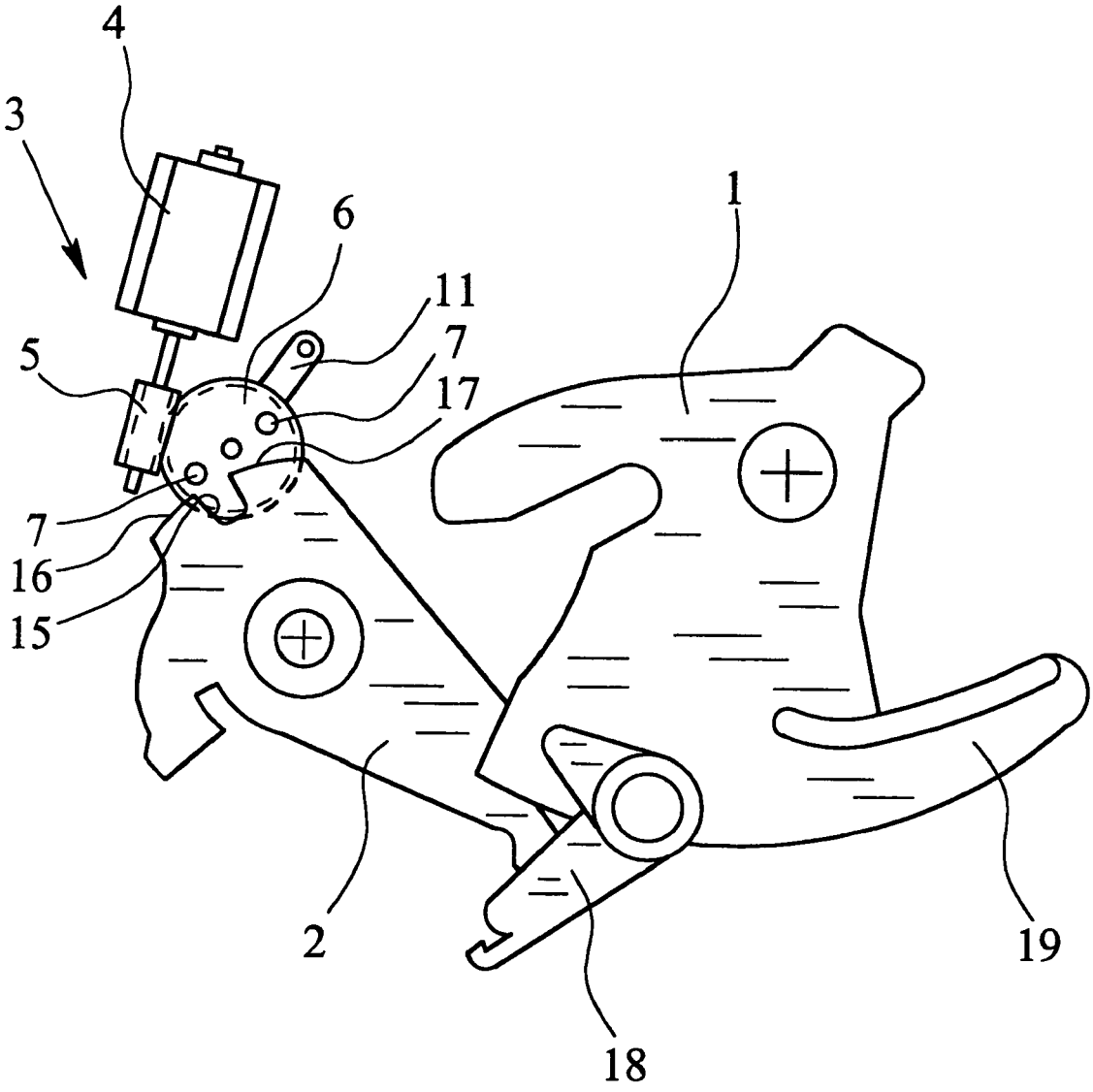
FIG. 2 is a schematic depiction of a third embodiment of a motor vehicle lock in accordance with the invention with an electrical opening drive in the closed position.

FIG. 2 shows another embodiment of a motor vehicle lock as claimed in the invention which likewise achieves the aforementioned object. Here, it is provided that the drive element 6 of the opening drive 3 as in FIG. 1 opens the blocking element 2 in the first direction of motion. In the second direction of motion, here, the opening drive 3 also turns on the second function. However, this takes place in that, in any case, with the blocking element 2 closed, preferably with the blocking element 2 closed and opened, the drive element 6 is blocked by the blocking element 2 itself or by the other lever which is coupled to the blocking element 2 after a certain path. FIG. 2 does not show the control electronics 8 and the inside door handle 9 and switch, which can likewise be assumed here. In turn, a double lock lever 11 is shown as an example of a lever of the lock mechanism. It is controlled proceeding from the back of the drive element 6 which is likewise made here as a worm wheel in the manner as is explained below.

Figure 2A:
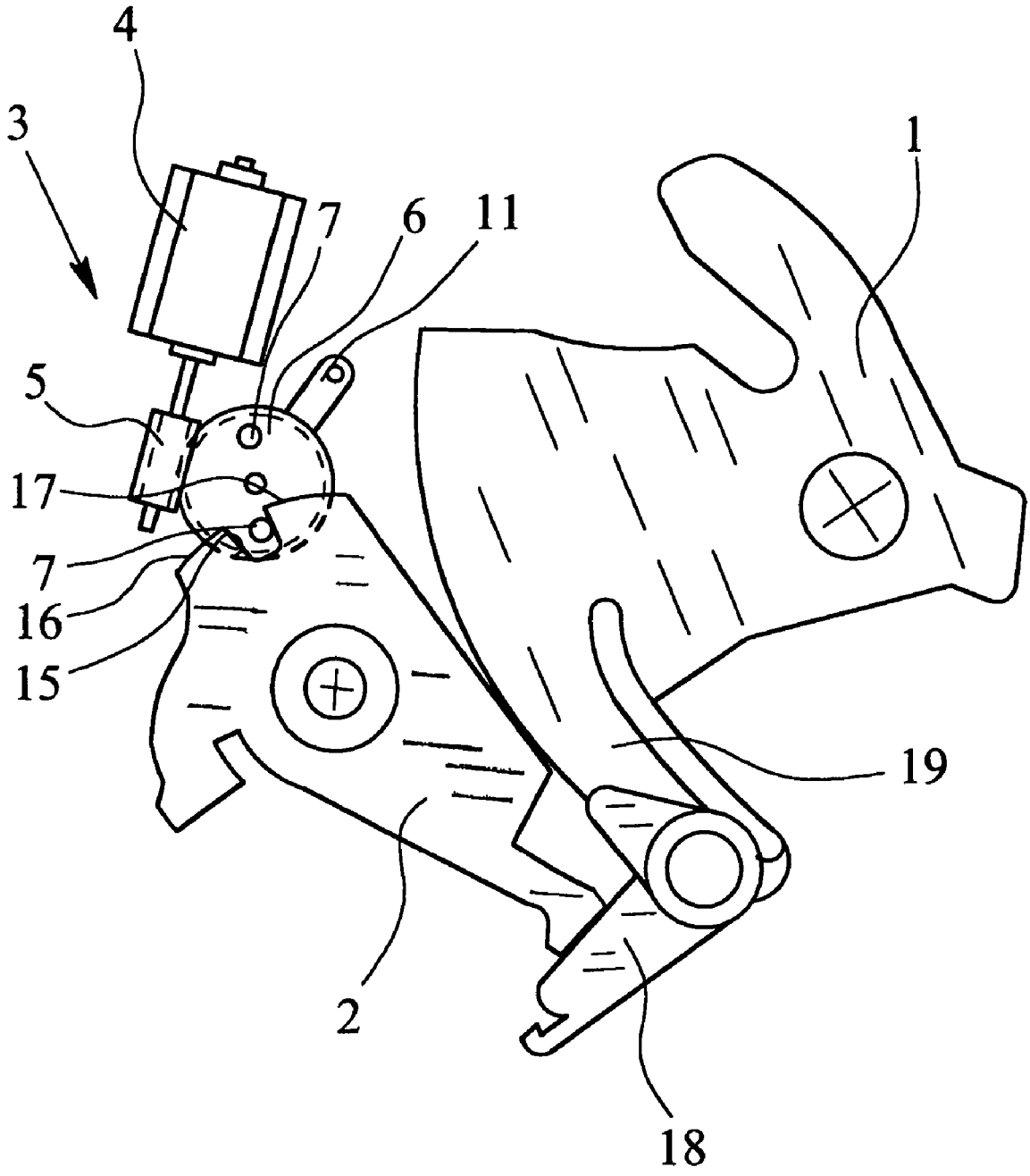
FIG. 2*a* shows the FIG. 2 embodiment in the open position.

In this mode of operation, it is of interest that, here, a construction of the opening drive 3 has been selected as is otherwise found normally in central locking drives. This embodiment shows specifically that the blocking element 2 itself on one end has a fork receiver 15 next to which there are arc-shaped stop surfaces 16, 17 for two driver journals 7 on the drive element 6. By running one of the driver journals 7 against one of the stop surfaces 16, 17, the opening drive 3 is turned off. When the drive element 6 turns counterclockwise in FIG. 2, the blocking element 2 is opened, and the ratchet 2 therefore lifted out of the latch 1. The latch 1, which moves in the direction of opening, keeps the ratchet 2 in the raised position (FIG. 2*a*). In this position, if the opening drive 3 is triggered in the opposite direction, therefore in the second direction of motion, the drive element 6 turns clockwise and the driver journal 7 comes into contact with the stop surface 17 and is blocked. The opening drive 3 is turned off. This blocking function can be used to control the double lock lever 11 by means of the drive element 6. The double lock lever 11 is thus shifted into the double lock DL operating state.

This embodiment shows otherwise that the drive element 6 interacts with the blocking element 2 or the other lever such that, with the opening drive 3 turned off, manual adjustment of the blocking element 2 or the other lever is possible, unhindered by the drive element 6. This is also known from the field of central locking drives as such and is explained extensively in the prior art.

FIG. 2 shows another particularity which has been long known from the field of motor vehicle locks as such. Specifically, there is a storage element 18 in the form of a storage lever which is assigned to the blocking element 2 in the form of the ratchet. On the latch 1, there is an appropriately shaped control contour 19 by which the storage element 18 can be released from the blocking element 2 for the latch 1 turning in the direction of opening. Such a storage element 18 is commonly known as a "snow load lever" in motor vehicle locks.

If the latch 1 is not completely opened and the control contour 19 does not eject the storage element 18 which keeps the blocking element 2 open, the blocking element 2 is kept permanently by the storage element 18 in the open position, the door or hatch can no longer be closed. This situation can occur, for example, when the door is not opening, is frozen or sticking. For such an emergency, in this embodiment, it is provided that the storage element 18 is arranged and/or made such that the storage element 18 which is in the storage position can be overtravelled manually or by a motor with increased action of the force. In particular, this can be accomplished by the storage element 18 being a preferably plastic lever which buckles, bends away or in some other way releases the blocking element 2 under the increased action of a force. The storage element 18 can, for example, have a corresponding scored site. In normal operation, the forces are such that the storage element 18 works normally. Only in emergency operation can the forces become so great that the storage element 18 buckles. This is possible by the opening drive 3 operating in the second direction of motion in emergency operation and accordingly the force ratios can be deliberated oriented to this emergency operation.

Figure 3:
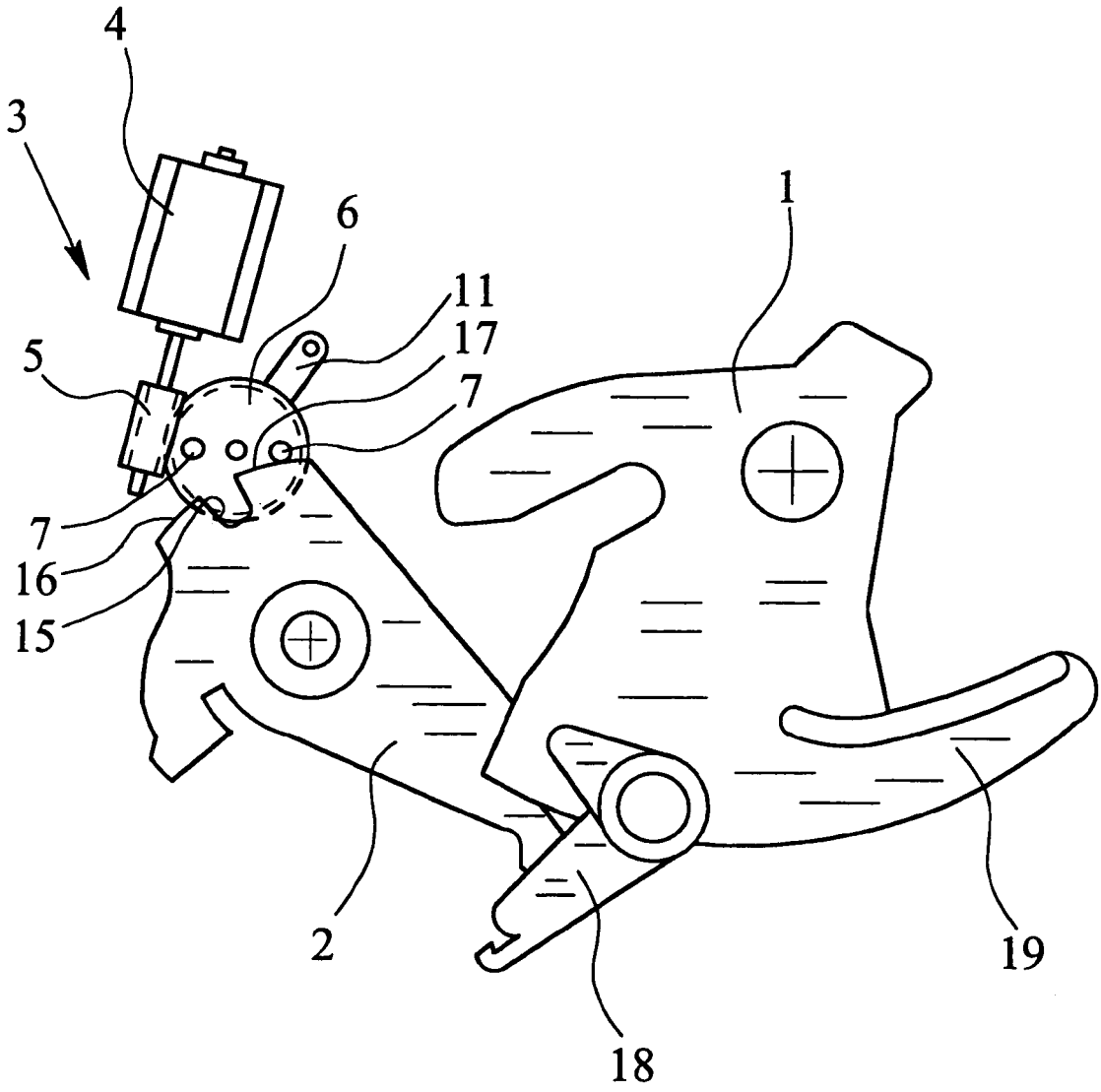
FIG. 3 shows the FIG. 2 embodiment with modified drive element of the opening drive.

In FIG. 2, the driver journals 7 on the drive element 6 of the opening drive 3 are in the position which is assumed upon turning-off in block operation after lifting of the blocking element 2. FIG. 3 shows how the drive element 6 causes the opening drive 3 to be turned off after completion of a second function by block operation. Here, the driver journal 7 comes to rest against the stop surface 17 by blocking and stops there.

Figure 4:
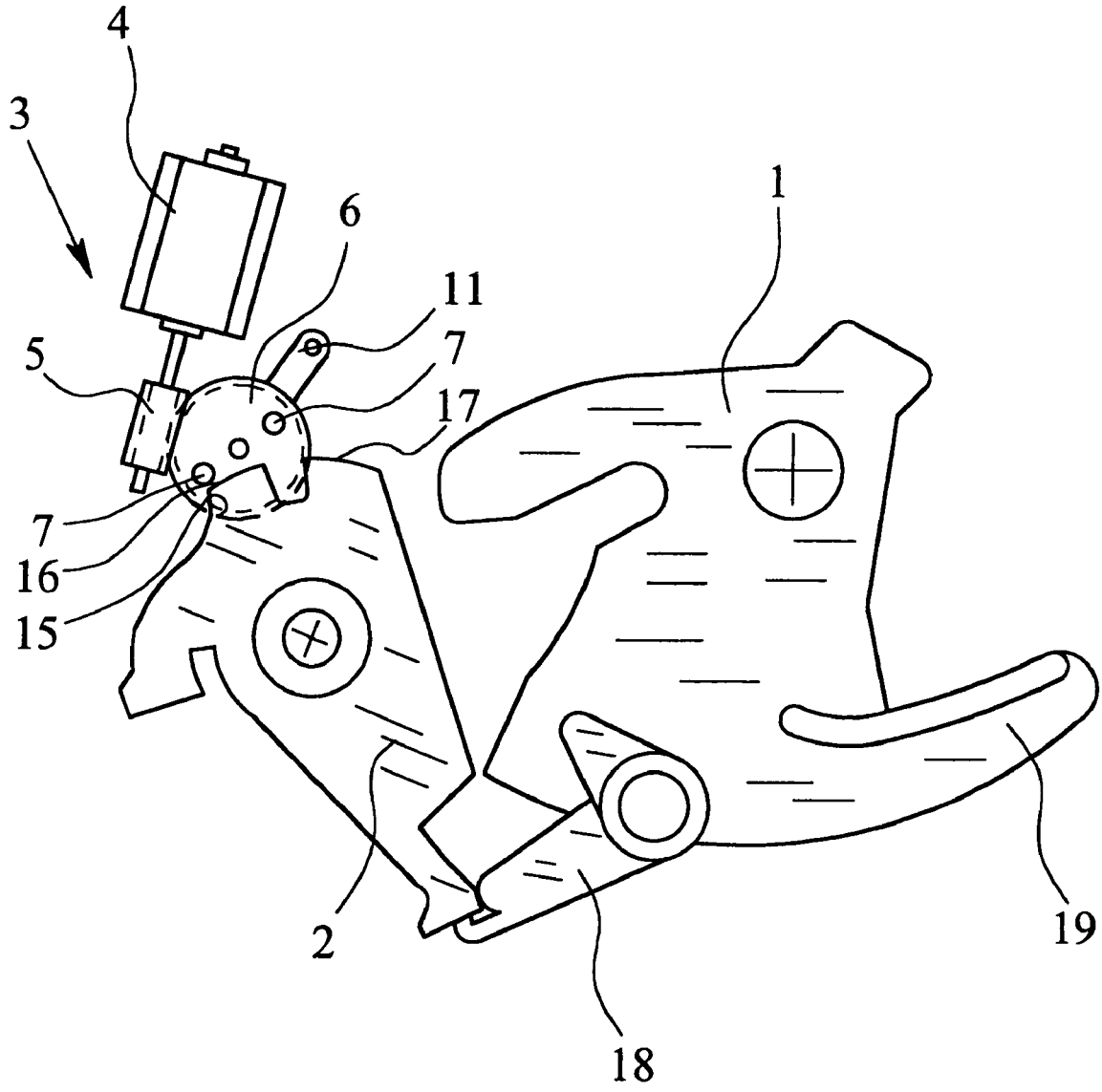
FIG. 4 shows the FIG. 2 embodiment with the ratchet in the raised position.

FIG. 4 shows the above explained position of this motor vehicle lock with the blocking element 2 held by the storage element 18 in the open position.

Figure 5:
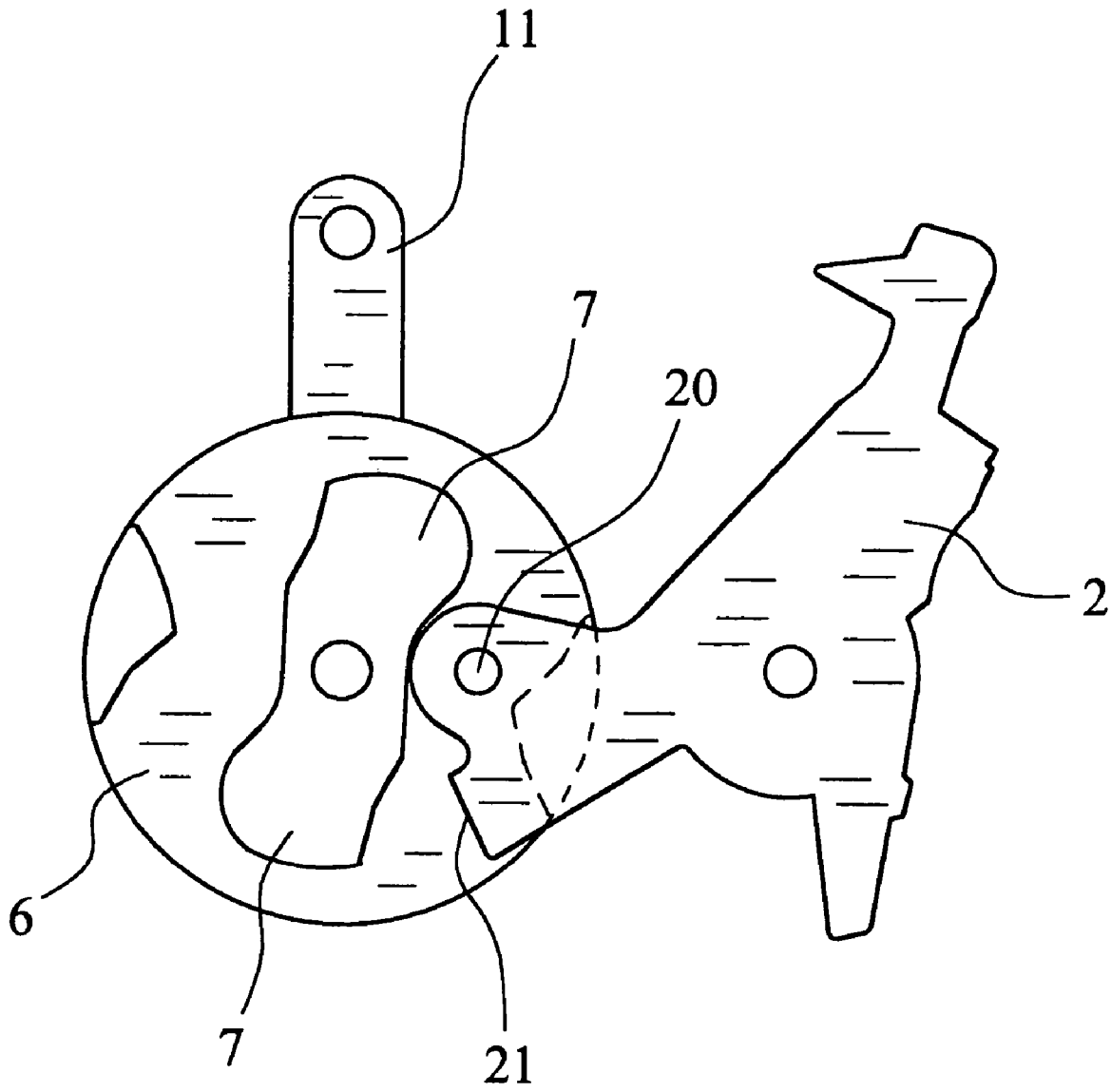
FIG. 5 is a schematic depiction of an embodiment of a motor vehicle lock in accordance with the invention with an electrical opening drive.

FIG. 5 shows a construction similar to FIG. 2 with an opening drive 3 which has a crank which has several positions in the manner of a central locking drive. In this regard, reference should be made especially to co-pending U.S. patent application Ser. No. 10/684,255 (commonly owned) for the disclosure of such a structure. Based on the reference numbers used, it is apparent in FIG. 3 that the second direction of motion is the counterclockwise direction of rotation. Here, the double lock lever 11 is triggered from the back of the drive element 6, for example, via a construction which is similar to the double lock of U.S. Pat. No. 6,557,387 (commonly owned), and therefore has the corresponding catch projections, etc. The journal 20 on the blocking element 2 interacts here with the driver journal 7. In the opposite direction the driver 7 makes contact with the stop 21 of the blocking element 2 by blocking and thus turns on the second function.

The motor vehicle lock shown in FIG. 5 has a drive element 6 which is made symmetrically such that at least two positions of the drive element 6 which are equivalent in terms of the action of the drive element 6 on the blocking element 2 are assigned to one operating state of the blocking element 2. This has the advantage that overly long free-running of the drive element 6 up to reaching a certain position can be avoided, since this certain position in the symmetrical configuration viewed over the adjustment range of the drive element 6 is present at least twice. With the side stops on the outside edge of the drive element 6, the corresponding control of the adjustment motion of the drive element 6 is enabled by blocking operation.

In general, for motor vehicle locks of the type under consideration, the levers of the lock mechanism or the like, to prevent freezing, are equipped with a coating of a material which prevents freezing, especially PTFE. Thus, a problem which often arises in motor vehicle locks and which is caused by the fact that moisture continuously enters the lock mechanism is solved. A PTFE coating allows water to flow off more easily and accordingly prevents freezing from the start.

What is claimed is:

1. Motor vehicle lock, comprising:

a movable latch, a blocking element for holding the latch in a locked position, a motorized opening drive for the blocking element, a lock mechanism for separately locking the motor vehicle lock, control electronics which are adapted to electrically trigger individual functions of the motor vehicle lock, and wherein individual functions can also be mechanically triggered in case of an emergency by the lock mechanism, wherein the opening drive has a drive element which opens or releases the blocking element in one direction of motion as a first function, wherein the control electronics are adapted for turning on and off of a second function of the motor vehicle lock by electrical-control engineering means without influencing the lock mechanism and without moving the opening drive, and wherein the second function is also adapted to be mechanically turned off during normal operation by releasing or opening the blocking element with the opening drive.

2. Motor vehicle lock as claimed in claim 1, wherein the blocking element is a ratchet.

3. Motor vehicle lock as claimed in claim 1, wherein the latch is made as a rotary latch.

4. Motor vehicle lock as claimed in claim 1, wherein the motorized opening drive is an electrical opening drive.

5. Motor vehicle lock as claimed in claim 1, further comprising a crash sensor, and wherein the second function is also turned off mechanically when the crash sensor delivers a corresponding signal.

6. Motor vehicle lock as claimed in claim 1, wherein the second function is one of a double lock (DL) function, a child safety (CS) function, and a center lock (CL) function, and wherein turning off of the second function results in turning on of another function.

7. Motor vehicle lock as claimed in claim 6, wherein the other function that is turning on when the second function is turned off is an unlocking function.

8. Motor vehicle lock as claimed in claim 1, wherein the drive element of the opening drive is drivable in each of two opposing directions of motion, wherein movement of the drive element in a first direction opens or releases the blocking element and movement of the drive element in a second direction of motion turns on the second function of the motor vehicle lock.

9. Motor vehicle lock as claimed in claim 1, wherein the second function is a double lock function (DL) and wherein turning off of the second function causes the motor vehicle lock to return into a function which is not double-locked.

10. Motor vehicle lock as claimed in claim 1, wherein the second function is a child safety function (CS) and wherein turning off of the second function causes the motor vehicle lock to return into a function which is not child-safe.

11. Motor vehicle lock as claimed in claim 1, wherein the lock mechanism has a second motorized drive, and wherein mechanical turning off of the second function of the motor vehicle lock takes place by means of the second motorized drive.

12. Motor vehicle lock as claimed in claim 11, wherein the mechanical turning off of the second function by means of the second motorized drive is adapted to be triggered both by the opening drive and also by a crash sensor.

13. Motor vehicle lock as claimed in claim 12, wherein the second motorized drive is a central locking drive.

14. Motor vehicle lock, comprising:

a movable latch, a blocking element for holding the latch in a locked position, a motorized opening drive for the blocking element, control electronics which are adapted to electrically trigger individual functions of the motor vehicle lock, and a lock mechanism by which individual functions can also be mechanically triggered in case of an emergency, wherein the opening drive has a drive element which opens or releases the blocking element in one direction of motion as a first function, wherein the control electronics are adapted for turning on and off a second function of the motor vehicle lock by electrical-control engineering means without influencing the lock mechanism and without moving the opening drive, and wherein the second function is also adapted to be mechanically turned off during normal operation when the opening drive opens or releases the blocking element.

15. Motor vehicle lock as claimed in claim 14, wherein the second function is one of a double lock (DL) function, a child safety (CS) function, and a center lock (CL) function.

* * * * *